United States Patent [19]

May et al.

[11] 4,443,221

[45] Apr. 17, 1984

[54] TANNING METHOD

[75] Inventors: Max May, Bottmingen, Switzerland; Rolf Monsheimer, Darmstadt; Ernst Pfleiderer, Darmstadt-Arheilgen, both of Fed. Rep. of Germany

[73] Assignee: Rohm GmbH, Darmstadt, Fed. Rep. of Germany

[21] Appl. No.: 380,617

[22] Filed: May 21, 1982

Related U.S. Application Data

[63] Continuation-in-part of Ser. No. 354,202, Mar. 3, 1982, Pat. No. 4,398,911, which is a continuation of Ser. No. 169,847, Jul. 17, 1980, abandoned.

[30] Foreign Application Priority Data

Jul. 26, 1979 [DE] Fed. Rep. of Germany ..... 2930342

[51] Int. Cl.[3] ..... C14C 11/00; C14C 1/04; C14C 1/08; C14C 1/06

[52] U.S. Cl. ..... 8/94.16; 8/94.17; 8/94.19 R; 8/94.21; 8/94.27; 8/94.32; 8/94.33

[58] Field of Search ..... 8/94.16, 94.17, 94.19, 8/94.21, 94.27, 94.32, 94.33

[56] References Cited

U.S. PATENT DOCUMENTS

| | | | |
|---|---|---|---|
| 490,791 | 1/1893 | Mellinger | 8/44.16 |
| 1,976,679 | 10/1934 | Fikentscher et al. | 8/94.21 |
| 2,768,056 | 10/1956 | Kirk | 8/94.18 |
| 3,408,319 | 10/1968 | Rau | 260/23 AR |
| 3,850,575 | 11/1974 | Larsen | 8/94.18 |
| 3,945,792 | 3/1976 | Wurmli et al. | 8/94.21 |
| 3,986,926 | 10/1976 | Monsheimer et al. | 435/265 |
| 4,187,074 | 2/1980 | Träubel et al. | 8/94.19 R |

FOREIGN PATENT DOCUMENTS

| | | |
|---|---|---|
| 1930225 | 2/1970 | Fed. Rep. of Germany . |
| 425201 | 3/1935 | United Kingdom . |
| 433815 | 8/1935 | United Kingdom . |
| 474991 | 11/1937 | United Kingdom . |
| 585135 | 1/1947 | United Kingdom . |
| 1172055 | 11/1969 | United Kingdom . |
| 1407488 | 9/1975 | United Kingdom . |
| 271704 | 9/1970 | U.S.S.R. . |
| 507648 | 4/1976 | U.S.S.R. . |

OTHER PUBLICATIONS

Stather, "Gerbereichemie und Gerbereitechnologie" Akademie-Verlag, Berlin (1967), pp. 607-608.

Siebott, "Tylose in der Lederindustrie" (Tylose in the Leather Industry).

"Handbook of Chemistry and Physics", 36th Ed., Chemical Rubber Publishing Co., pp. 1956.

*Primary Examiner*—Maria Parrish Tungol

*Attorney, Agent, or Firm*—Curtis, Morris & Safford

[57] ABSTRACT

What are disclosed are improved methods for the preparation of leather wherein, in one or more steps for preparing leather from limed animal skins or hides, including beamhouse operations such as deliming, bating, pickling, and degreasing to prepare unhaired tannable hides from animal skins or hides, and including subsequent tanning, retanning, and dyeing steps performed on said unhaired tannable hides, small amounts of a high polymeric water soluble cellulose ether or of an acrylic polymer are added to at least one of the treating baths involved in such method steps as a lubricant for said skins or hides.

16 Claims, No Drawings

TANNING METHOD

This application is a continuation-in-part of U.S. patent application Ser. No. 354,202 filed Mar. 3, 1982, now U.S. Pat. No. 4,398,911, which in turn is a continuation of U.S. patent application Ser. No. 169,847 filed July 17, 1980, now abandoned.

The present invention relates to an improved method for the preparation of leather.

Leather is prepared by working predominantly in an aqueous milieu. The preparation of the skin for tanning takes place in the so-called beamhouse. Hair, epidermis, and subcutaneous tissues must be removed since only the true corium with the papillary layer (grain) and reticular layer (support layer) can be used for the preparation of leather.

Treatment of the skins in the beamhouse as a rule encompasses the method steps of soaking, hair loosening, opening of the hide structure, and bating. The true tanning of the skin follows this. All these steps were developed during the course of long craft tradition and have to date undergone numerous improvements and adaptations to modern technology [cf. E. Stather, "Gerbereichemie und Gerbereitechnologie" ("Tanning Chemistry and Tanning Technology"), Akademie-Verlag, Berlin (1977)].

With ever-increasing urgency, ecological problems force themselves to the forefront of this technology. The scope of this problem can be measured, for example, by the fact that, together with waste water, about 50 percent of the amount of raw skins delivered for the preparation of leather are lost as untanned or tanned wastes. Further, the waste water is contaminated by the chemicals which are added in the individual process stages and are in part not used [cf. Ullmann's "Encyclopaedie der technischen Chemie", ("Encyclopedia of Technical Chemistry"), 4th Edition, Vol. 16, Verlag Chemie, (1978), pages 126–127].

The consumption of water in the preparation of leather can, first, be significantly decreased by changing production from a still medium to an agitated medium. When working with rotating closed vats, one reckons with the use of about 25 $m^3$ of waste water per ton of weight of raw hides in comparison with about 75–125 $m^3/t$ when the hides are hung in pits and there is a gradual consumption of the baths using the countercurrent principle.

According to traditional technology, the waste water from soaking which contains the salt, used for conserving, dissolved out of the skin, in addition to suspended dirt and soluble protein; the baths containing liming residues—which contribute about 80 percent of the poisonous impurities (sulfide) which occur—; the remains of the deliming and bating baths with dissolved calcium and ammonium salts; the pickling baths; and, as the second most important component, the remains of the baths from chrome tanning with unconsumed chrome tanning materials, neutral salts; and still in addition the baths remaining from neutralization, dyeing, and fat-liquoring, all accumulate. Contrary to this technology is the demand to reduce the consumption of water, and thus the amount of waste water, to a minimum. Thus, the tendency is to work in the smallest amount of bath, i.e. the shortest float, possible. Further, modern machine combinations (for example tanning drums or mixtures) were developed which permit a heating and recycling of the baths during the course of the process.

New developments in the process brought further relief. Thus, U.S. Pat. No. 3,986,926, incorporated herein by reference, recommends an enzymatic method for the preparation of dehaired skins ready for tanning, in which soaking, dehairing, opening of the hide structure, and bating are carried out in a single working operation (one step method). Nevertheless, even in face of these modern developments, the demand remains for a still more rational utilization of the water reserve. On the other hand, the quality of the products which are prepared cannot suffer under any circumstances.

It has now been found that the above-described methods for the preparation of leather from skins and hides can be carried out in an extremely small amount of bath, that is in a very short float, if small amounts of certain materials are added during the known course of the methods.

More in particular, the amount of float employed is from about 30 percent of the weight of the skins and hides being treated to at most 100 percent of their weight, preferably between 40 and 80 percent, and more preferably from 30 to 50 percent. When such a short float is used, frictional damage to the skins and hides being treated can occur as the result of the skins and hides rubbing against one another and/or the vessel in which they are being treated. When a small amount, i.e. from 0.01 to at most 0.2 percent, by total weight of the float or bath, of an additive according to the present invention is present in the float, the additive acts as a lubricant for the skins and hides and permits the use of a short float without significant frictional damage to the materials being treated. While the additives used, preferably high polymeric water soluble cellulose ethers and acrylic polymers, can be characterized as "thickening agents" because of their ability to increase the viscosity of aqueous solutions to which they are added, the materials are employed according to the present invention in such small concentrations that no significant thickening of the baths to which they are added is effected. Rather, as noted above, the agents at small concentrations essentially impart lubricity to the baths and their contents and can primarily be viewed as lubricants.

Preferred lubricants or "thickening agents" are high polymeric materials having a molecular weight such that their Brookfield viscosity, measured at 20° C. on a 3% aqueous solution, is from 5 to 50000 mPas, preferably from 10 to 30000 mPas, and particularly preferably from 100 to 10000 mPas. The additives do not form deposits on the skins or hides being treated and do not enter into any bonding reactions with materials of the skin.

Cellulose ether products, particularly carboxyalkyl cellulose, methyl cellulose, ethyl cellulose, hydroxymethyl cellulose, hydroxyethyl cellulose, hydroxypropylmethyl cellulose, and hydroxybutylmethyl cellulose have particular significance. (The last-mentioned can be prepared, for example, by the action of ethylene oxide, of propylene oxide and methyl chloride, or of butylene oxide and methyl chloride, on cellulose under basic conditions.) They are, for example, obtainable commercially under the tradenames "Methocel" or "Natrosor". Suitably, the cellulose ethers have a molecular weight between 100 and 700.

Further, anionic polyelectrolytes, particularly polymers comprising acrylic acid or methacrylic acid, as well as polymers of maleic acid or its anhydride and, to a lesser degree those of crotonic acid, itaconic acid, and others, optionally with the addition of other suitable monomers such as acrylamide and methacrylamide, esters of acrylic acid and methacrylic acid, for example the esters of $C_1$–$C_4$ alcohols such as methyl methacrylate, ethyl acrylate and butyl acrylate, as well as other polymerizable vinyl compounds such as styrene, heterocyclic vinyl compounds such as N-vinyl pyrrolidone, vinyl caprolactam, etc., preferably in the form of their alkali metal salts and ammonium salts, such as the sodium salts of polyacrylic acid, are of particular significance. It is to be understood that the choice of lubricant takes into consideration the other parameters of the bath. Thus, the use of anionic polymers of the acrylate type is predominantly in the alkaline to neutral region. Both the use of soluble solid products as well as dispersions is contemplated. The lubricants can also be used combined in a suitable fashion.

Suitable representatives of this class of acrylic compounds are commercially available, for example under the tradename "ROHAGIT". The structure and properties of these materials are described in more detail in the publication of Roehm & Haas GmbH, Darmstadt, Germany entitled "ROHAGIT Wasserloesliche Acrylharze" ("ROHAGIT Water Soluble Acrylic Resins"), incorporated herein by reference.

In addition to anionic materials, the "ROHAGIT" resins include acrylpolymethacrylates having cationic character, particularly in the acid region, as well as ampholytic materials having both anionic and cationic groups. In such ionic materials, alkali metal or ammonium acrylate or methacrylate salts, dialkylaminoalkyl acrylates or methacrylates, or the quaternary ammonium salts of such dialkylaminoalkyl esters, may be present in the polymers in an amount from 6 to 100 percent by weight of all monomers, preferably in an amount from 30 to 100 percent by weight. Cationic quaternary polyelectrolytes are discussed in detail in a review article by Hoover in J. Macromol. Sci.-Chem. A4 (6), 1327–1417 (1970).

Although the lubricants mentioned above are effective if used alone at the concentrations indicated, they can also be used in combination with a variety of natural organic and inorganic materials which contribute lubricating properties. Such materials include, for instance, agar-agar, carageenan, tragacanth, gum arabic, alginates, pectins, guar flour, carob flour, starches, dextrins, glues, gelatin, and casein. Modified organic materials such as modified starches and starch derivatives can also be used, as can carob flour ethers. As inorganic lubricants, polysilicic acids, clay minerals such as montmorillonite, zeolites, and others, come into consideration.

The technical treatment according to the present invention can be directed:

A. to processes in the beamhouse involving the method step of deliming and bating, i.e. for the preparation of dehaired skins and hides, ready for tanning, and B. to the true tanning, particularly the process techniques of (a) chrome tanning or (b) synthetic-vegetable fast tanning, and (c) combination tanning, and C. to wet methods for dressing leather—

(i) neutralization of chrome leather, (ii) retannage of chrome leather, and (iii) dyeing and fat-liquoring of chrome leather.

The aforementioned method steps can be carried out in a very small amount of bath according to the present invention. The content of the lubricant or "thickening agent" to be used according to the invention can vary within certain limits—depending on the individual agents and their relative efficacy, but, as noted earlier, the amount is in general rather small. Amounts of lubricant from 0.01 to at most 0.2 percent, by weight of the total bath, are contemplated. In many cases, the addition of from 0.01 to 0.1 percent is sufficient.

In deliming and bating, it is recommended in the technology employed until now to increase the amount of bath after a short treatment period in order to avoid grain damage by friction effects. When a lubricant is added according to the present invention, this is not necessary since this grain damage is avoided by such addition. Surprisingly it was learned that when lubricants are added, the deliming effect and bating effect are reached after considerable shorter periods of time than heretofore. Apart from the shortening of the duration of the process, the procedure according to the present invention follows the methods representative of the state of the art.

Pickling and chrome tanning can be carried out according to the present procedure with amounts of bath of 20–40 percent (compared with common methods). In this way, contamination of the waste by salts is reduced and absorption of the tanning materials is improved. Treatment times shorter than those used with conventional working methods are sufficient to achieve fastness to boiling.

In a cross-section, a more uniform distribution of chromium is observed. Even for skins of a heavy provenance, an astonishingly fine grain structure is achieved. The method step of pickling and chrome tanning according to the invention follows the methods representative of the state of the art.

In the procedure according to the invention, the usual difficulties which occur on synthetic-vegetable fast tanning are not observed. In this connection, grain damage due to friction effects on drumming in a small amount of bath, as well as problems in connection with thorough tanning and the distribution of tanning agent in heavy skin material, are particularly to be mentioned. Such problems are otherwise observed above all in the preparation of chamois leather or of sole leather having a thickness greater than 5 mm.

In the neutralization and retannage of chrome leather, a particularly rapid absorption of tanning materials is found, as well as a uniform coloration (as an expression of uniform pH-conditions) throughout the entire thickness of the leather when a cross-section is tested with bromcresol green solution. In the procedure of the invention, uniform, brilliant color tones are achieved on dyeing. A brightening of the color tone, as often occurs when synthetic tanning materials are employed, does not occur.

On fat-liquoring, a good absorption as well as a high degree of utilization of the bath are found. Also for the method steps of neutralization, of retannage of chrome leather, of dyeing, and of fat-liquoring, the corresponding method steps according to the state of the art can be referred to when proceeding according to the invention.

In the enzymatic method steps according to the present invention, additives for the enzymatic reaction such as activators, stabilizers, etc., known in the art, can be used. The proteolytic efficacy of enzymes is conventionally determined according to the Anson hemoglobin method [M. L. Anson, J. Gen. Physiol. 22, 79 (1939)], or according to the Loehlein-Volhard-Method ["die Loehlein-Volhard'sche Methode zur Bestimmung der proteolytischen Aktivitaet", Gerbereichem. Taschenbuch", Dresden-Leipzig (1955)]in terms of "LVU" (Ioehlein-Volhard units). By one Loehlein-Volhard Unit is to be understood that amount of enzyme which, under the specific conditions of the method, digests 1.725 mg of casein.

A better understanding of the present invention and of its many advantages will be had by referring to the following specific Examples, given by way of illustration.

Example 1: Deliming and Bating

The bath contains:

15.0 percent of water (30° C.),
0.1 percent of hydroxypropylmethyl cellulose,
0.02 percent of carob bean flour,
0.8 percent of ammonium chloride, and
0.4 percent of sodium bisulfite.

The treatment time is 20 minutes. For bating, the following are then added:

0.03 percent of trypsin (250,000 LVU), and
0.9 percent of ammonium sulfate.

The process is carried out for a further 40 minutes. The final pH value in the bath is 8.2. A test for deliming effect on a cross section of the dehaired skin using phenolphthalein solution reveals that the two exterior thirds of the hide are colorless and the interior third is red colored. The dehaired skins are free of dirt, scud, and short hairs at the end of the bating. They are permeable to air and have a very fine grain structure in which no drumming damage can be observed even on examination with a lens, despite the small amount of bath. The diffusion of the chemicals takes place rapidly and uniformly. The percentage values pertain to the weight of the materials introduced (dehaired skins).

Similar good results in deliming and bating are otained if the hydroxypropylmethyl cellulose in the aforementioned bath is replaced with 0.3 percent of a cationic copolymer of 3-dimethylamino-2,2-dimethylpropyl methacrylate, methyl acrylate, and butyl acrylate (55:15:30 by weight), added as an aqueous solution containing 40% solids, having a pH of 7, and having a Brookfield viscosity of 8000 mPa.s as a 3% solution (non-acidified).

Example 2: Chrome Tanning 1000 kg of delimed and bated goatskins are first washed in a vat with 150 percent of water (25° C.) for 20 minutes. The bath is then discarded.

Pickle:

20 percent of water (20° C.),
0.1 percent of hydroxyethyl cellulose.

Agitate for 20 minutes and add 3.0 percent of sodium chloride.

Agitate for 10 minutes and add 0.4 percent of sulfuric acid (technical, 98 percent, diluted 1:10).

Agitate for 30 minutes. The pH value of the bath is 3.4–3.6.

Similar good results in pickling are obtained if the hydroxyethyl cellulose in the aforementioned bath is replaced with 0.1 percent of the cationic polymer described in Example 1.

Chrome Tanning:

Chrome tanning follows in the pickling bath with addition of 6.0 percent of an organic masked chrome tanning agent having a $Cr_2O_3$-content of 30 percent and a basicity of 50 percent.

The treatment time is 6 hours. The pH value of the bath at the end of treatment is 3.7.

Using this method employing a small amount of bath containing hydroxyethyl cellulose, the penetration of the chemicals in the pickle and the chrome tanning are considerably accelerated. Thus, in the pickle a uniform, bright green-colored skin cross-section is observed after a treatment time of only 30 minutes. The leather was stable to boiling after a treatment time of six hours. It shows no grain damage. The percentage values pertain to the amount of skin material treated (dehaired hides).

Similar good results are obtained in the chrome tanning if an acrylic polymer is used in the bath, instead of hydroxyethyl cellulose.

Example 3: Synthetic Vegetable Fast Tanning 3,000 kg of washed, delimed, and bated cowhides are added to the bath residue remaining in the vat, together with:

10.0 percent of a synthetic tanning material comprising a phenol-formaldehyde-condensation product with a tanning agent content of about 40 percent,
0.05 percent of hydroxybutylmethyl cellulose, and
0.02 percent of sulfated train oil, emulsified 1:5.

Agitate for one hour and add 0.8 percent of formic acid (technical, 85 percent, diluted 1:5).

Treatment is continued for a further hour. The pH value of the bath is 4.3.

Testing of the leather cross-section with a solution of bromcresol green shows uniform green coloration, uniform tanning, and uniform acidification.

Complete tanning follows with:

10.0 percent of quebracho extract (powder).

Treat for one hour and add:

10.0 percent of mimosa extract (powder),
1.0 percent of a synthetic dispersable tanning agent comprising a condensation product of aromatic sulfonic acids and formaldehyde,
0.2 percent of sulfated train oil (emulsified 1:5), and
10 percent of water (20° C.).

Treat for a further hour and add:

10.0 percent of mimosa extract (powder) and
20.0 percent of water, (20° C.).

Treatment is continued for seven hours.

The final temperature of the bath should be 35° C. The leather remains overnight in the tanning bath. It is advantageous to agitate for 5 to 10 minutes from time to time. Before the leather is removed, it is recommended that it be washed for one to two hours with 200 percent of water at 25° C.

By the use of hydroxybutylmethyl cellulose, the distribution and uniform diffusion of the tanning agents into the leather cross-section are significantly accelerated. This is evident from the short operational times between the individual additions. Whereas normally the through-tanning of heavy materials without the addition of lubricants leads to difficulties and can often not be attained even using long treatment times, such problems are not observed when cellulose ethers are employed.

After finishing, the leather has a uniform bright color, a soft hand, and shows no grain damage. The percentage values are referred to the weight of the skin material introduced in a dehaired condition (dehaired weight). The amount of tanning agents refer to trade goods and not to pure tanning agents.

Similar good results in tanning are obtained if the 0.05 percent of hydroxybutylmethyl cellulose used in the tanning bath are replaced by an equal amount of a cationic polymer like that described in Example 1.

Example 4: Neutralization, Retannage, Dyeing, and Fat-liquoring for Upper Leather from Cowhides 3,000 kg of shaved chrome leather skin halves are first washed in a tanning machine with:

50 percent of water (25° C.) and
0.5 percent of sodium formate.

The treatment time is 20 minutes. The bath is subsequently discarded.

Neutralization:

15.0 percent of water (25° C.),
1.0 percent of neutralization tanning agent, and
0.06 percent of hydroxypropylmethyl cellulose are introduced.

The batch is agitated for 20 minutes. The pH value of the bath is 4.8.

(Alternatively, the hydroxypropylmethyl cellulose can be replaced with an equal amount of the cationic copolymer described in Example 1.)

Dyeing:

1.0 percent of anionic leather dye are added and the batch is agitated for 20 minutes.

Fat-liquoring:

7.0 percent of an anionic emulsifiable fat-liquoring agent for leather comprising synthetic or animal crude fat is added. The fat-liquoring agents are emulsified with water at 60° C. in a ratio of 1:5 before addition.

The treatment time is 20 minutes.

The auxiliary agents are taken up by the leather more rapidly and uniformly. The amount of accumulated waste water is minimal. The finished leather has a soft hand, is very uniformly dyed, and has an extraordinarily fine grain structure. The percentage amounts are referred to the weight of the leather (shaved weight).

Example 5: Vat-dyeing 1,000 kg of shaved chrome tanned calf leather are neutralized according to the conventional working method. Dyeing follows in a fresh bath with:

20 percent of water (50° C.) and
0.2 percent of methyl cellulose.

Agitate for 10 minutes and add:

0.5 percent of a 1:1 metal complex dyestuff.

Agitate for 20 minutes.

Fat-liquoring can be done in the same bath. The absorption of the dye into the leather takes place more rapidly than usual. Before the leather is removed, a washing step should be introduced.

The finished leather shows a brilliant uniform dyeing. Also, the wash water is practically free of dye residues. The percentages figures refer to the weight of the treated leather (shaved weight).

Similar good results are obtained if the methyl cellulose lubricant is replaced in the bath by an equal amount of a 70:30 copolymer (by weight) of sodium methacrylate: methyl methacrylate (acid number=410–430 mg KOH/g), a 3% aqueous alkaline solution of which has a Brookfield viscosity of 1500–2300 mPas.

Example 6: Fat-liquoring of Leather for Clothing

Starting material: pickled dehaired sheepskins. The pickled dehaired skins are first chrome-tanned in the usual way. Retannage, neutralization, and dyeing follow.

Fat-liquoring is carried out in a fresh bath with:

50 percent of water (60° C.),
4 percent of sulfated wool fat,
2 percent of sulfated sperm oil, and
4 percent of an anionic synthetic leather fat-liquoring agent.

Agitate for 10 minutes and add 0.04 percent of hydroxyethyl cellulose.

Agitate for 10 minutes.

After this period of time, the fat-liquoring agent is completely absorbed. After a brief washing, the leather can be taken from the vat. The percentage figures pertain to the partially dry weight.

Similar good results are obtained if the hydroxyethyl cellulose in the bath is replaced by a 70:30 copolymer (by weight) of methacrylic acid:methyl methacrylate (acid number=410–430 mg KOH/g), a 3% aqueous alkaline solution of which has a Brookfield viscosity of 7700–11000 mPas.

Example 7: Degreasing

For degreasing, 1,000 kg of sheepskins were bated and pickled and then thoroughly drained. Draining can take place either by dripping or by pressing off the water. Degreasing followed in a vat with:

3.0 percent of ethoxylated nonylphenol,
0.2 percent of hydroxymethyl cellulose, and
0.2 percent of odorless petroleum ether.

The skins are drummed for 60 minutes.

Washing follows with:

500 percent of water (35° C.).

Washing is carried out for 30 minutes. The washing process is repeated twice, after which the fat emulsion is completely removed.

After tanning, leather with a clean readily dyeable grain and a soft hand is obtained.

The percentage figures pertain to the weight of material which in this case is equal to the weight of the dehaired skins.

Example 8: Deliming of Goat Skins 2,000 kg of unhaired goat skins are delimed with:

30 percent of water (30° C.),
2.0 percent of ammonium chloride, and
0.5 percent of cellulose methylhydroxyethylether.

The skins are agitated for 20 minutes.

Even after this short period of time, the unhaired skins are fully delimed throughout. They show no red coloration when tested with phenolphthalein solution.

The subsequent bating can be carried out in the same bath.

The percentage figures for the chemicals are referred to the weight of material which, in this case, is the weight of the unhaired skins.

Similar good results are obtained if the cellulose methylhydroxyethyl ether is replaced by an equal amount of a 70:30 copolymer (by weight) of ammonium methacrylate:methyl methacrylate (acid number=410–430 mg KOH/g), a 3% aqueous alkaline solution of which has a Brookfield viscosity of 1500–2300 mPas.

Example 9: Retannage of Leather for Sheepskin Clothing

Sheepskins having a trimmed weight of 2,000 kg are retanned in a vat with:

30 percent of bath (50° C.), 0.2 percent of hydroxypropylmethyl cellulose, and 6.0 percent of emulsified fat.

The skins are agitated for 30 minutes. The following is added to the bath:

4.0 percent of glutardialdehyde (25 percent diluted 1:5).

The batch is again agitated for 30 minutes.

The skins are now rinsed for 10 minutes with running water at 30° C.

After storage overnight, the skins are partially dried.

Very soft sweat-resistant leather was obtained which could be readily dyed.

The percentage figures refer to the weight of the material which in this case is the same as the trimmed weight.

Similar good results are obtained if the hydroxypropylmethyl cellulose is replaced in the bath by an equal amount of the cationic copolymer described in Example 1.

What is claimed is:

1. A process for the preparation of leather from skins and hides, which process includes the steps of deliming and bating for the preparation of unhaired skins and hides ready for tanning as well as the subsequent steps of tanning and dressing said unhaired skins and hides, wherein at least one float used in said process comprises from 0.01 to 0.2 percent, by weight of said float, of a lubricating material not binding to said skins and hides and selected from the group consisting of water soluble acrylate and methacrylate polymers, said float being used in an amount which is at most 100 percent of the weight of the skins and hides being treated therein.

2. A process as in claim 1 wherein said float is used in an amount from 40 to 80 percent by weight of the skins and hides being treated therein.

3. A process as in claim 1 wherein said float is used in an amount from 30 to 50 percent by weight of the skins and hides being treated therein.

4. A process as in claim 1 wherein said lubricating material has a Brookfield viscosity, measured at 20° C. in a 3% aqueous solution, between 5 and 50000 mPas.

5. A process as in claim 1 wherein said lubricating material is a water soluble methacrylate polymer.

6. A process as in claim 1 wherein said lubricating material is added to a float used for the preparation of unhaired skins and hides from skins and hides.

7. A process as in claim 1 wherein said lubricating material is added to a float used in deliming unhaired hides.

8. A process as in claim 1 wherein said lubricating material is added to a float used in bating unhaired hides.

9. A process as in claim 1 wherein said lubricating material is added to a float used for tanning unhaired skins and hides.

10. A process as in claim 1 wherein said lubricating material is added to a float used in retanning leather.

11. A process as in claim 1 wherein said lubricating material is added to a float used for fat-liquoring.

12. A process as in claim 1 wherein said lubricating material is used in a float used for dyeing leather.

13. A process as in claim 1 wherein said lubricating material is used in a float used for degreasing.

14. A process as in claim 1 wherein said lubricating material is added to a float used for the one-step preparation of unhaired skins and hides, ready for tanning from skins and hides, said float being an aqueous alkaline float comprising (a) at least one member selected from the group consisting of a fungus protease whose optimum efficacy towards casein is at a pH above 7.0, trypsin, papain, and a bacterial protease whose optimum efficacy is at a pH between 6 and 9, (b) a bacterial protease having an optimum efficacy toward hemoglobin at a pH above 9, and (c) a short-chain primary or secondary aliphatic amine, whereby concurrent soaking, dehairing, opening of the hide structure, and bating are effected in a single procedural step.

15. A process as in claim 1 wherein said lubricating material is a water soluble acrylate polymer.

16. A process which includes the steps of deliming and bating as well as the steps of tanning and dressing of unhaired skins and hides for the production of leather wherein the process includes the addition of an effective amount of a water-soluble acrylic polymer to the processing bath.

* * * * *